US010648310B2

(12) United States Patent
Frosell et al.

(10) Patent No.: US 10,648,310 B2
(45) Date of Patent: May 12, 2020

(54) FRACTURING ASSEMBLY WITH CLEAN OUT TUBULAR STRING

(71) Applicant: Halliburton Energy Services, Inc., Houston, TX (US)

(72) Inventors: Thomas Jules Frosell, Irving, TX (US); Gary John Geoffroy, Plano, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 16/082,518

(22) PCT Filed: May 6, 2016

(86) PCT No.: PCT/US2016/031305

§ 371 (c)(1),
(2) Date: Sep. 5, 2018

(87) PCT Pub. No.: WO2017/192152

PCT Pub. Date: Nov. 9, 2017

(65) Prior Publication Data

US 2019/0085674 A1 Mar. 21, 2019

(51) Int. Cl.

| | |
|---|---|
| ***E21B 12/06*** | (2006.01) |
| ***E21B 17/06*** | (2006.01) |
| ***E21B 23/00*** | (2006.01) |
| ***E21B 33/068*** | (2006.01) |
| ***E21B 37/00*** | (2006.01) |
| ***E21B 43/26*** | (2006.01) |

(Continued)

(52) U.S. Cl.
CPC ..... *E21B 43/26* (2013.01); *E21B 12/06* (2013.01); *E21B 17/06* (2013.01); *E21B 23/00* (2013.01); *E21B 33/068* (2013.01); *E21B 37/00* (2013.01); *E21B 43/267* (2013.01); *E21B 2034/007* (2013.01)

(58) Field of Classification Search
CPC ..... E21B 12/06; E21B 17/06; E21B 23/00; E21B 33/068; E21B 34/14; E21B 37/00; E21B 43/26; E21B 43/267
See application file for complete search history.

(56) References Cited

U.S. PATENT DOCUMENTS 5,343,953 A * 9/1994 Patel ..... E21B 17/06 166/237
5,425,424 A * 6/1995 Reinhardt ..... E21B 33/16 166/291

(Continued)

OTHER PUBLICATIONS

International Search Report and Written Opinion of PCT Application No. PCT/US2016/031305 dated Jan. 24, 2017: pp. 1-16.

*Primary Examiner* — Matthew R Buck
(74) *Attorney, Agent, or Firm* — Chamberlain Hrdlicka

(57) ABSTRACT

A wellbore apparatus positionable within a wellbore with a tubular string includes a fracturing assembly and a latch. The fracturing assembly includes a housing comprising a flowbore formed therein and a port, a flow control device configured to move with respect to the housing to selectively allow fluid communication from the flowbore to an exterior of the housing through the port, and a wellbore securing device configured to secure the fracturing assembly within the wellbore. The latch is configured to removably couple the fracturing assembly to the tubular string.

16 Claims, 5 Drawing Sheets

(51) Int. Cl.
*E21B 43/267* (2006.01)
*E21B 34/00* (2006.01)

(56) References Cited

U.S. PATENT DOCUMENTS

| | | | | |
|---|---|---|---|---|
| 6,053,250 | A * | 4/2000 | Echols | E21B 17/06 166/242.7 |
| 7,243,723 | B2 * | 7/2007 | Surjaatmadja | E21B 34/14 166/278 |
| 7,458,422 | B2 * | 12/2008 | Adam | E21B 21/10 166/207 |
| 7,708,076 | B2 * | 5/2010 | Richard | E21B 7/20 166/377 |
| 9,556,693 | B2 * | 1/2017 | HallundbæK | E21B 43/103 |
| 2002/0020534 | A1 | 2/2002 | Wilson et al. | |
| 2002/0117301 | A1 | 8/2002 | Womble | |
| 2011/0278010 | A1 * | 11/2011 | Fehr | E21B 33/124 166/308.1 |
| 2012/0067564 | A1 | 3/2012 | Mack et al. | |
| 2012/0168163 | A1 | 7/2012 | Bertoja et al. | |
| 2013/0081817 | A1 | 4/2013 | Norrid et al. | |
| 2013/0153220 | A1 * | 6/2013 | Carter | E21B 33/128 166/285 |
| 2013/0319695 | A1 * | 12/2013 | Krawiec | E21B 34/14 166/387 |
| 2014/0166912 | A1 * | 6/2014 | Larisey | E21B 43/26 251/61 |
| 2015/0129197 | A1 | 2/2015 | Purkis et al. | |
| 2015/0053408 | A1 | 5/2015 | Andreychuk et al. | |

* cited by examiner

FRACTURING ASSEMBLY WITH CLEAN OUT TUBULAR STRING

BACKGROUND

This section is intended to provide relevant contextual information to facilitate a better understanding of the various aspects of the described embodiments. Accordingly, it should be understood that these statements are to be read in this light and not as admissions of prior art.

Hydrocarbon-producing wells often are stimulated by hydraulic fracturing (e.g., fracking) operations, in which a servicing fluid, such as a fracturing fluid or a perforating fluid, may be introduced into a portion of a subterranean formation penetrated by a wellbore at a hydraulic pressure sufficient to create or enhance at least fractures within the subterranean formation. The servicing fluid may include sand or other proppants suspended within the fluid such that the proppant is able to hold the fractures open within the subterranean fluid after the hydraulic pressure is removed. Such a subterranean formation stimulation treatment may increase hydrocarbon production from the well.

At times when using the proppant and pumping the proppant into the wellbore, the proppant carried by the fluid may accumulate and build up in a treating work string positioned within the wellbore, or within the wellbore itself, often referred to as a "sand out." In such instances, the treating work string needs to be removed from the wellbore and replaced by a clean out work string to remove and recirculate the proppant. Once cleaned, the clean out work string may then be replaced by the treating work string. However, these additional trips with the work string and the clean out string may add several days, or more, overall to complete the hydraulic fracturing operation.

BRIEF DESCRIPTION OF THE DRAWINGS

For a detailed description of the embodiments of the invention, reference will now be made to the accompanying drawings in which.

DETAILED DESCRIPTION

Figure 1:
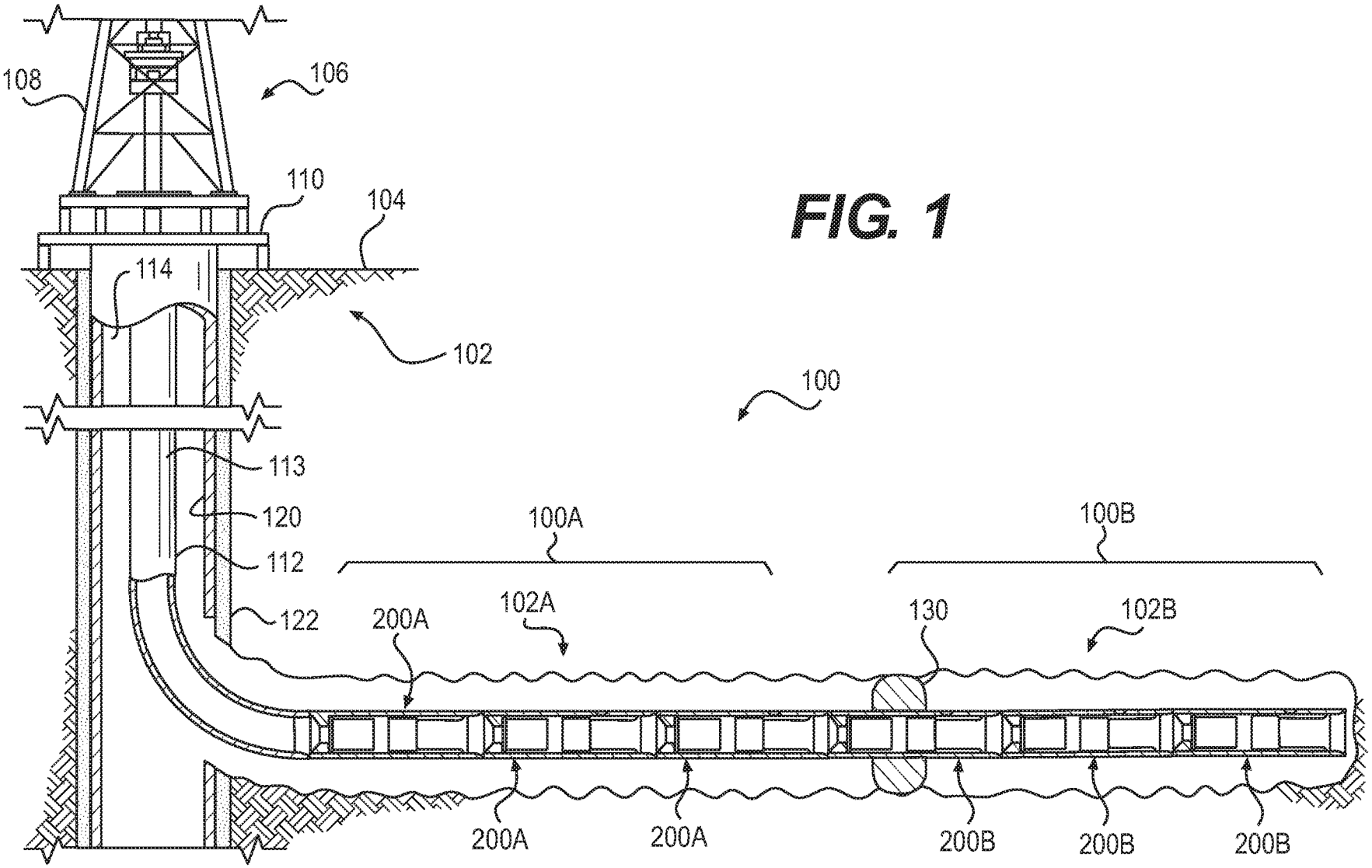
FIG. 1 is a schematic view of an offshore oil and gas system including a wellbore servicing apparatus according to one or more embodiments.

The present disclosure includes apparatuses, systems, and methods for positioning and cleaning out a fracturing assembly with a tubular string within a wellbore. As discussed below, the tubular string is used to deploy and position the fracturing assembly in a desired position and orientation within the wellbore. A wellbore securing device, such as a packer or a hanger, is used to secure the fracturing assembly within the wellbore, and a latch is used to removably couple the fracturing assembly to the tubular string to position the fracturing assembly within the wellbore with the tubular string.

The fracturing assembly includes a housing with a flowbore formed therein and a port, and a flow control device configured to move with respect to the housing to selectively allow fluid communication from the flowbore to an exterior of the housing through the port. The flow control device is adjustable to enable the tubular string to be inserted within a bore of the sliding sleeve when the fracturing assembly and the tubular string are decoupled from each other, such as when cleaning out the fracturing assembly from proppant building up within the fracturing assembly. The flow control device may be a sliding sleeve that is moved between a closed position to prevent fluid communication through the port and an open position to enable fluid communication through the port. The movement can be caused by placing a seat engagement (e.g., ball or dart) device on an engageable seat that subsequently has pressure applied to the seat and the seat engagement device. The movement may also be caused by a hydraulic piston (e.g., hydrostatic or applied pressure), by an electro-mechanical mechanism (e.g., a linear actuator), and/or by a direct mechanical movement by a shifting tool (e.g., through coiled tubing, slick line, or jointed tubing) Accordingly, one or more of the sliding sleeves may be electrically actuated, hydraulically actuated, pneumatically actuated, mechanically actuated, and/or the like.

In one embodiment, such as the sliding sleeve being hydraulically actuated, the seat may be selectively movable from an expanded position to enable the seat engagement device to pass through the seat and a retracted position to engage the seat engagement device. An inner diameter of the seat in the expanded position is then larger than an outer diameter of a lower portion of the tubular string to enable the tubular string to pass through the seat of the sliding sleeve for cleaning out the fracturing assembly with the tubular string. In other embodiments, the sliding sleeve may include a flapper, a ball valve, an elastomeric seal (e.g., compressed), such as in replacement of the seat, to move and hydraulically actuate the sliding sleeve. Accordingly, the sliding sleeves may be selectively actuated and individually movable with respect to each other in the above hydraulically actuated embodiment, as well as in other embodiments, including but not limited to embodiments having electrically actuated sliding sleeves, pneumatically actuated sliding sleeves, and/or mechanically actuated sliding sleeves. Selected example embodiments are discussed below, for purpose of illustration, in the context of an onshore oil and gas system. However, it will be appreciated by those skilled in the art that the disclosed principles are equally well suited for use in other contexts, such as on other types of oil and gas rigs, including offshore oil and gas rigs.

Referring to FIG. 1, an embodiment of an operating environment in which a wellbore servicing apparatuses, systems, and methods may be employed is illustrated. It is noted that although some of the figures may exemplify horizontal or vertical wellbores, the principles of the apparatuses, systems, and methods disclosed may be similarly applicable to horizontal wellbore configurations, conventional vertical wellbore configurations, and combinations thereof. Therefore, the horizontal or vertical nature of any figure is not to be construed as limiting the wellbore to any particular configuration.

As depicted in FIG. 1, the operating environment generally comprises a wellbore 114 that penetrates a subterranean formation 102 for the purpose of recovering hydrocarbons, storing hydrocarbons, disposing of carbon dioxide, or the like. The wellbore 114 may be drilled into the subterranean formation 102 using any suitable drilling technique. In an embodiment, a drilling or servicing rig 106 includes a derrick 108 with a rig floor 110 through which a work string 112 (e.g., a tubular string, a drill string, a tool string, a segmented tubular string, a jointed tubular string, a casing string, or any other suitable conveyance, or combinations thereof) generally defining an axial flowbore 113 may be positioned within or partially within the wellbore 114. In an embodiment, the work string 112 may comprise two or more concentrically positioned strings of pipe or tubing (e.g., a first work string may be positioned within a second work string). The drilling or servicing rig 106 may be conventional and may include a motor driven winch and other associated equipment for lowering the work string 112 into the wellbore 114. Alternatively, a mobile workover rig, a wellbore servicing unit (e.g., coiled tubing units), or the like may be used to lower the work string 112 into the wellbore 114. While FIG. 1 depicts a stationary drilling rig 106, one of ordinary skill in the art will readily appreciate that mobile workover rigs, wellbore servicing units (such as coiled tubing units), and the like may be employed.

The wellbore 114 may extend substantially vertically away from the earth's surface over a vertical wellbore portion, or may deviate at any angle from the earth's surface 104 over a deviated or horizontal wellbore portion. In alternative operating environments, portions or substantially all of the wellbore 114 may be vertical, deviated, horizontal, and/or curved.

In the embodiment of FIG. 1, at least a portion of the wellbore 114 is lined with a casing 120 that is secured into position against the formation 102 in a conventional manner using cement 122. In alternative operating environments, the wellbore 114 may be partially or fully uncased and/or uncemented. In an alternative embodiment, a portion of the wellbore may remain uncemented, but may employ one or more wellbore securing devices, such as a packer 130, to isolate two or more adjacent portions or zones within the wellbore 114.

In the embodiment of FIG. 1, a wellbore servicing system 100 includes a fracturing or servicing assembly. In this embodiment, the fracturing or servicing assembly includes a first fracturing assembly cluster 100A and a second fracturing assembly cluster 100B incorporated within the work string 112 and positioned proximate and/or substantially adjacent to a first subterranean formation zone (or "pay zone") 102A and a second subterranean formation zone (or pay zone) 102B, respectively. Although the work string 112 and the fracturing assembly clusters 100A and 100B are shown as incorporated together, the present disclosure is not so limited, as the work string 112 and the fracturing assembly clusters 100A and 100B may be separate components that are coupled and connected to each other. Further, although the embodiment of FIG. 1 illustrates two fracturing assembly clusters, one of skill in the art viewing this disclosure will appreciate that any suitable number of fracturing assembly clusters may be similarly incorporated within a work string such as work string 112. Also, although the embodiment of FIG. 1 illustrates each fracturing assembly cluster 100A,100B as comprising three fracturing assemblies (fracturing assemblies 200A and 200B, respectively), one of skill in the art viewing this disclosure will appreciate that a fracturing assembly cluster like fracturing assembly clusters 100A, 100B may suitably alternatively comprise two, four, or even more fracturing assemblies. The fracturing assembly clusters 100A, 100B may have any number of fracturing assemblies 200, and then may be separated from each other using a wellbore securing device or wellbore isolation device, such as the packer 130.

In an embodiment, a fracturing assembly (cumulatively and non-specifically referred to as fracturing assembly 200) generally includes a housing, one or more flow control devices, such as a sliding sleeve, and a seat associated with each sliding sleeve. The housing may generally define an axial flowbore and may include one or more ports suitable for the communication of a fluid from the flowbore of the housing to and exterior of the housing. The sliding sleeve may be movable relative to the housing from a first position (e.g., a closed position) to a second position (e.g., an open position). When the sliding sleeve is in the first position, the sliding sleeve may obstruct fluid communication from the axial flowbore to an exterior of the housing via the one or more ports of the housing and, when in the second position, the sliding sleeve may allow fluid communication from the axial flowbore to the exterior of the housing via the one or more ports of the housing.

Figure 2:
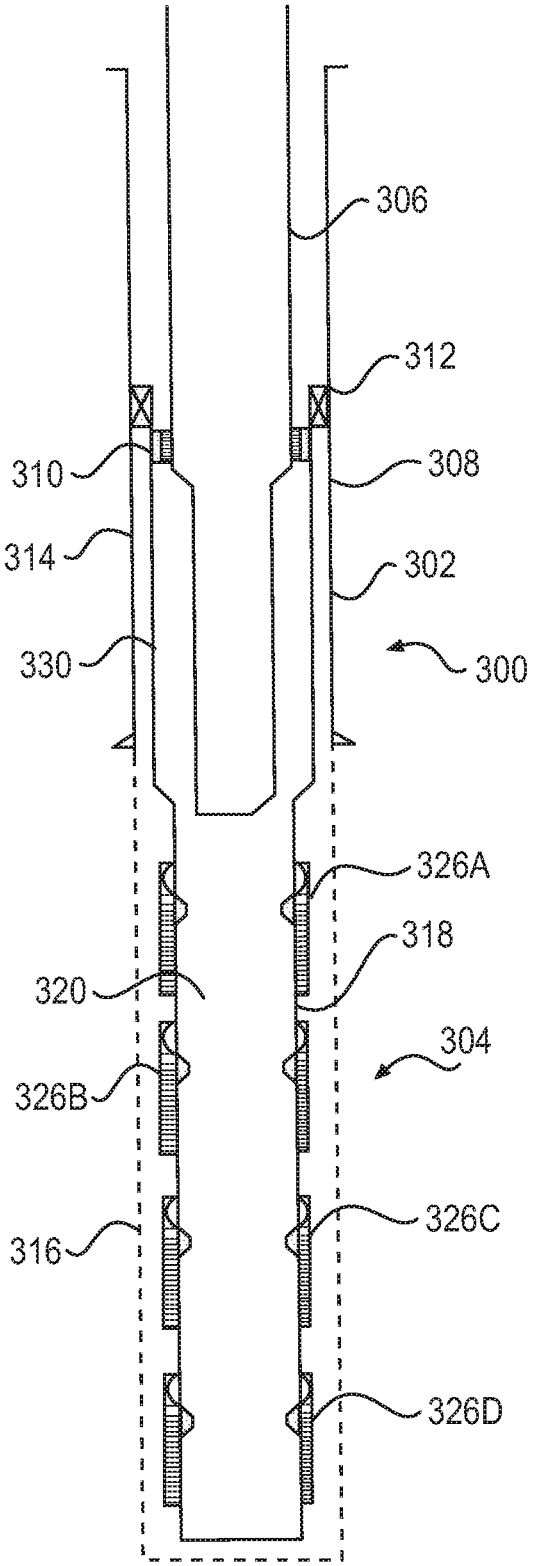
FIG. 2 is a cross-sectional view of a system with a fracturing assembly and a tubular string coupled to each other within a wellbore, according to one or more embodiments.
Figure 3:
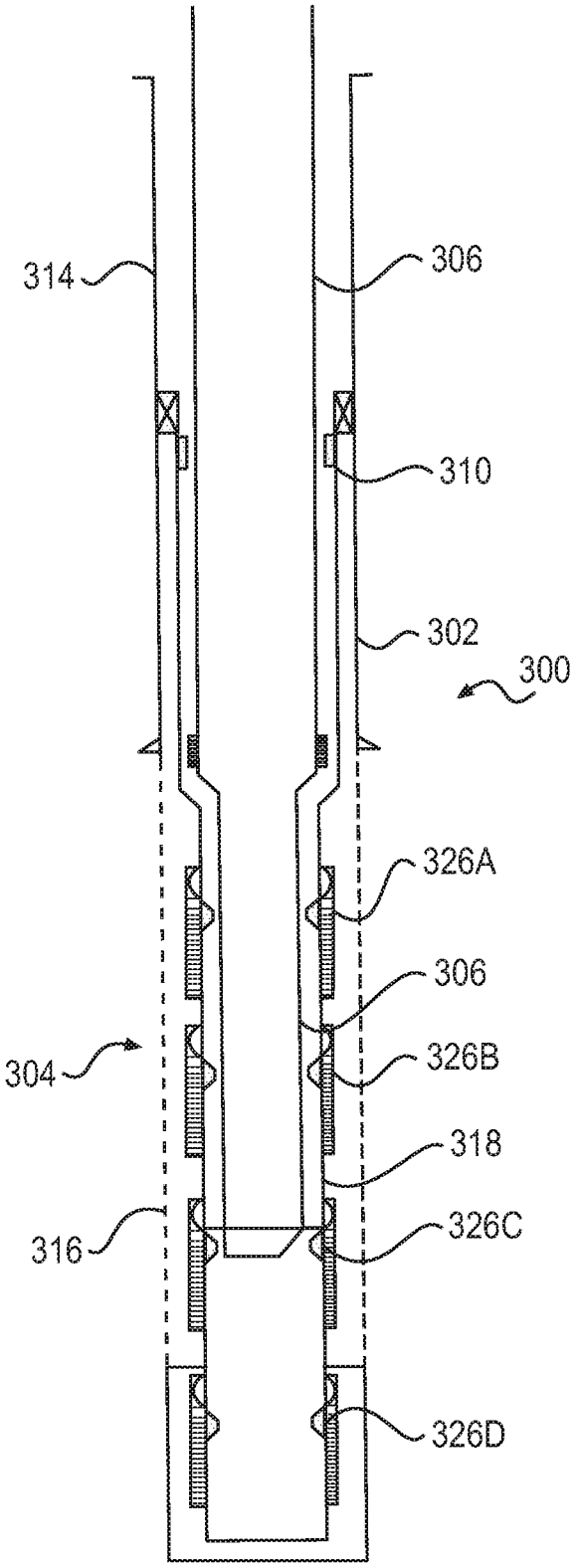
FIG. 3 is a cross-sectional view of a system with a fracturing assembly and a tubular string decoupled from each other within a wellbore, according to one or more embodiments.

Referring now to FIGS. 2 and 3, multiple cross-sectional views of a system 300 for servicing a wellbore 302 in accordance with one or more embodiments of the present disclosure are shown. The system 300 includes a fracturing assembly 304 and a tubular string 306, in which FIG. 2 shows a cross-sectional view with the fracturing assembly 304 and the tubular string 306 (e.g., work string) coupled to each other within the wellbore 302, and FIG. 3 shows a cross-sectional view with the fracturing assembly 304 and the tubular string 306 decoupled from each other and the tubular string 306 at least partially positioned within the fracturing assembly 304.

The wellbore 302 is formed within a subterranean formation and includes casing 308 lining a portion of the wellbore 302 to form a cased portion 314 of the wellbore, with the lower end of the wellbore 302 then defining an uncased portion 316. The system 300 is deployed into the wellbore 302 with the tubular string 306 and the fracturing assembly 304 coupled to each other through a latch 310 and one or more seals. The latch 310 may be carried or included within the tubular string 306, the fracturing assembly 304, and/or a combination of the two. As the tubular string 306 and the fracturing assembly 304 are coupled to each other, the tubular string 306 may be used to deploy and position the fracturing assembly 304 in a desired position and orientation within the wellbore 302. Further, the tubular string 306 and the fracturing assembly 304 may be in fluid communication with each other, in that a lower end of the tubular string 306 may be open such that fluid may flow between the interior of the tubular string 306 and the interior of the fracturing assembly 304 through the lower open end of the tubular string 306.

Once in a desired position, a wellbore securing device 312 may be used to secure the fracturing assembly 304 within the wellbore 302. The fracturing assembly 304 may be positioned within and extend into the uncased portion 316 of the wellbore 302, but the wellbore securing device 312 may set within the cased portion 314 of the wellbore 302 to secure against the casing 308. Additional tubing 330 may then be included at an upper end of the fracturing assembly 304 to position the lower portion of the fracturing assembly 304 within the uncased portion 316 of the wellbore 302.

The wellbore securing device 312 may be used to secure the fracturing assembly 304 within the wellbore 302. The wellbore securing device 312 may also be used as a wellbore isolation device to prevent fluid being communicated into an annulus formed between the wellbore 302 and an exterior of the fracturing assembly 304, such as fluid pumped on an exterior of the tubular string 306 from above the fracturing assembly 304. The wellbore securing device 312 may include a packer or a hanger to secure the fracturing assembly 304 within the wellbore 302. In an embodiment in which the wellbore securing device 312 includes a packer (e.g., a Versa-Trieve® provided by Halliburton), the packer may be a hydraulic-set packer, a hydrostatic-set packer and/or a mechanical-set packer. A hydraulic-set packer may be set by having a predetermined amount of hydraulic pressure exposed to packer, such as by having hydraulic pressure applied through the tubular string 306. A hydrostatic-set packer may be set by utilizing the hydrostatic pressure created by the column of fluid within the well to rupture a disc and flood an atmospheric chamber. A mechanical-set packer may be set by having a predetermined amount of tension, compression, or even torque applied to packer, such as through the tubular string 306.

Figure 4:
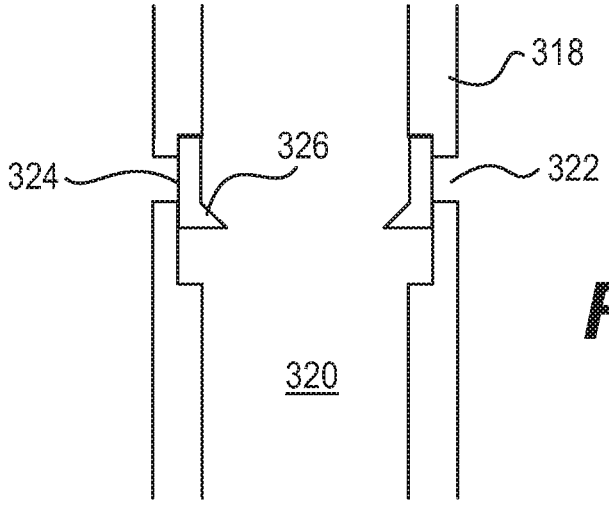
FIG. 4 is a cross-sectional view of a fracturing assembly with a sliding sleeve in a closed position and a seat in an expanded position, according to one or more embodiments.
Figure 5:
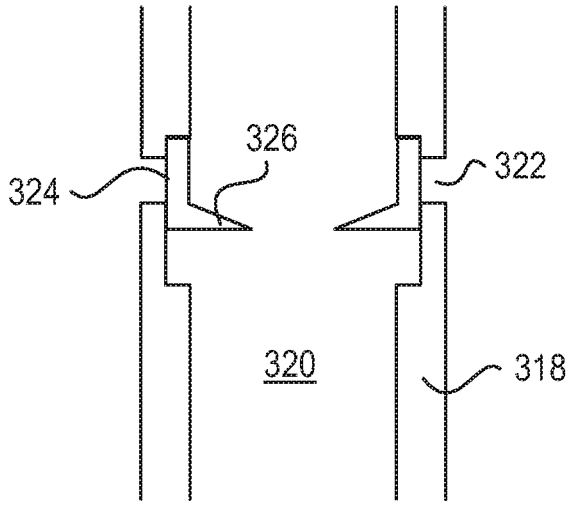
FIG. 5 is a cross-sectional view of a fracturing assembly with a sliding sleeve in a closed position and a seat in a retracted position, according to one or more embodiments.
Figure 6:
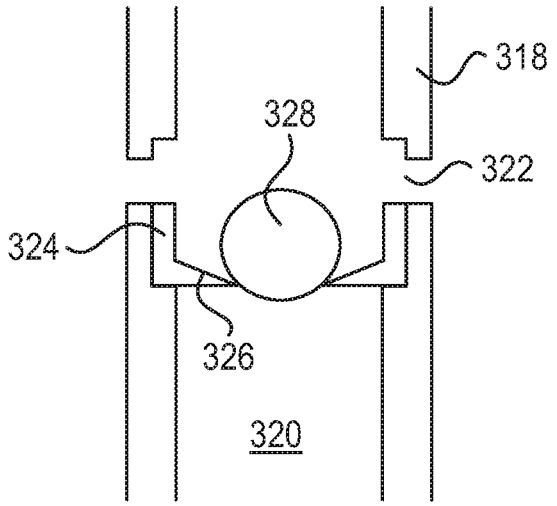
FIG. 6 is a cross-sectional view of a fracturing assembly with a sliding sleeve in an open position and a seat in a retracted position, according to one or more embodiments.

The fracturing assembly 304 includes a housing 318 having a flowbore 320 formed within the housing 318. FIGS. 4-6 show an enlarged cross-sectional view of the fracturing assembly 304 in accordance with one or more embodiments of the present disclosure. One or more ports 322 are formed within the housing 318 to enable fluid communication between the flowbore 320 and an exterior of the housing 318. One or more flow control devices may be included within the fracturing assembly 304 to selectively allow fluid communication from the flowbore 320 to an exterior of the housing 318. For example, in this embodiment, the flow control devices may each include a sliding sleeve 324 positioned within the fracturing assembly 304 and movable with respect to the housing 318 to selectively allow fluid communication from the flowbore 320 to an exterior of the housing 318 through the port 322. In particular, the sliding sleeve 324 is movable between a closed position, shown in FIGS. 4 and 5, to prevent fluid communication through the port 322, and an open position, shown in FIG. 6, to enable fluid communication through the port 322.

In an embodiment in which the sliding sleeves 324 are hydraulically actuated, one or more of the sliding sleeves 324 may include a seat 326 that is engageable with a seat engagement device 328 to move the sliding sleeve between the closed position and the open position. As multiple sliding sleeves 324 and seats 326 may be included within a fracturing assembly 304, the seats 326 may be selectively movable from an expanded position to enable the seat engagement device 328 to pass through the seat 326 and a retracted position to enable the seat 326 to engage the seat engagement device 328. In particular, FIG. 4 shows the seat 326 in an expanded position, in which the seat engagement device 328 could pass through the seat 326, and FIGS. 5 and 6 show the seat 326 in a retracted position, in which the seat 326 engages the seat engagement device 328. An inner diameter of the seat 326 constricts or retracts when moving from the expanded position to the retracted position. When the seat 326 is in the retracted position and is in engagement with the seat engagement device 328, pressure from fluid within the flowbore 320 of the fracturing assembly 304 may be used to then move the seat 326 from the closed position to the open position enable fluid communication through the port 322. The seat engagement device 328 may include a ball, as shown in FIG. 6, a dart, and/or any other type of seat engagement device known in the art.

When using a fracturing assembly 304 to treat and service the wellbore 302, it may be desired to selectively open the sliding sleeves 324 such that different areas or zones of the wellbore 302 may be individually treated. As the opening of the sliding sleeves 324 relies on using seat engagement devices 328 to engage seats 326 of the sliding sleeves 324 in this embodiment (as opposed to controlling the movement of the sliding sleeves 324 using other devices, such as electrically or mechanically actuated), the seats 326 of the sliding sleeves 324 may be selectively moved and controlled from the expanded position to the retracted position to thus treat and service different areas or zones of the wellbore 302 as needed.

The movement of the seats 326 from the expanded position to the retracted position may be controlled using one or more different methods. In one embodiment, the seats 326 may be individually and selectively controlled from a controller, such as on the surface or downhole, to selectively retract the seats 326. In another embodiment, the seats 326 may retract after a predetermined number of seat engagement devices 328 have passed through the seat 326. For example, in FIGS. 2 and 3, the fracturing assembly 304 is shown including four seats 326A-326D, a most upstream seat 326A, a second most upstream seat 326B, a second most downstream seat 326C, and a most downstream seat 326D. The most downstream seat 326D may not be retractable, as no other seats are included downstream of the seat 326D. However, the second most downstream seat 326C may be programmed or controlled such that the seat 326C will move from the expanded position to the retracted position after one seat engagement device 328 has passed through the seat 326C. One seat engagement device 328 may pass through the seat 326C, thereby allowing the seat engagement device 328 to flow further downstream and engage the most downstream seat 326D and enabling the wellbore 302 to be serviced and treated through a most downstream port associated with the most downstream seat 326D.

After the one seat engagement device 328 has passed through the second most downstream seat 326C, the seat 326C may then be programmed or controlled to move from the expanded position to the retracted position. This may enable the next seat engagement device 328 to engage the seat 326C, thereby enabling the wellbore 302 to be serviced and treated through a second most downstream port associated with the most second downstream seat 326C. The second most upstream seat 326B and the most upstream seat 326A may be similarly programmed or controlled. For example, the second most upstream seat 326B may be programmed or controlled to move from the expanded position to the retracted position after two seat engagement devices have passed through the seat 326B. The most upstream seat 326A may then be programmed or controlled to move from the expanded position to the retracted position after three seat engagement devices have passed through the seat 326A.

Fracturing fluid may then be pumped through the ports 322 of the fracturing assembly 304 to selectively treat and service different zones of the wellbore 302. For example, when the most downstream seat 326D has engaged and been moved by a seat engagement device, fracturing fluid may be pumped through the tubular string 306, into the fracturing assembly 304, and out through the port 322 associated with the most downstream seat 326D, thereby treating the zone of the wellbore 302 adjacent the most downstream seat 326D. Once this zone has been adequately treated, the next seat engagement device may be introduced into the tubular string 306 to engage and move the second most downstream seat 326C. Fracturing fluid may then be pumped through the tubular string 306, into the fracturing assembly 304, and out through the port 322 associated with the second most downstream seat 326C, thereby treating the zone of the wellbore 302 adjacent the seat 326C. However, as the fracturing fluid may have proppant (e.g., sand) included therein, the proppant may accumulate within the fracturing assembly 304 to clog ports 322 within the fracturing assembly 304 and create a "sand out."

To facilitate the cleaning out of the fracturing assembly 304, the tubular string 306 may be lowered with respect to and inserted within the fracturing assembly 304. The fracturing assembly 304 and the tubular string 306 may decouple from each other and the tubular string 306 may be sized to be inserted within a bore of the seats 326. In particular, the inner diameter of the seats 326, when in the expanded position, is larger than an outer diameter of a lower portion of the tubular string 306 to enable the tubular string 306 to pass through the seats 326 included within the fracturing assembly 304.

To clean out the proppant accumulated within the fracturing assembly 304, cleaning fluid (e.g, fluid without proppant) may be reverse circulated throughout the tubular string 306 and the fracturing assembly 304. In particular, cleaning fluid may be pumped from the surface and into the annulus between the tubular string 306 and the casing 308. The tubular string 306 may be decoupled through the latch 310 from the fracturing assembly 304 and lowered to a zone of interest, as shown in FIG. 3. In this embodiment, proppant may have accumulated in the fracturing assembly 304 across the second most downstream seat 326C, so the tubular string 306 may be lowered into the fracturing assembly 304 through the seats 326B and 326A. The cleaning fluid may return to the surface through the interior of the tubular string 306, along with the proppant accumulation. Once the proppant accumulation has been cleared, the tubular string 306 may be removed from the fracturing assembly 304, and may be recoupled to the fracturing assembly 304 through the latch 310 if desired or may simply re-engage the seal(s) from the original run in hole position. Fracturing fluid may then again be pumped from the surface, through the tubular string 306, and out through the ports 322 of the fracturing assembly 304 to treat the remaining zones of interest in the wellbore 302.

Figure 7:
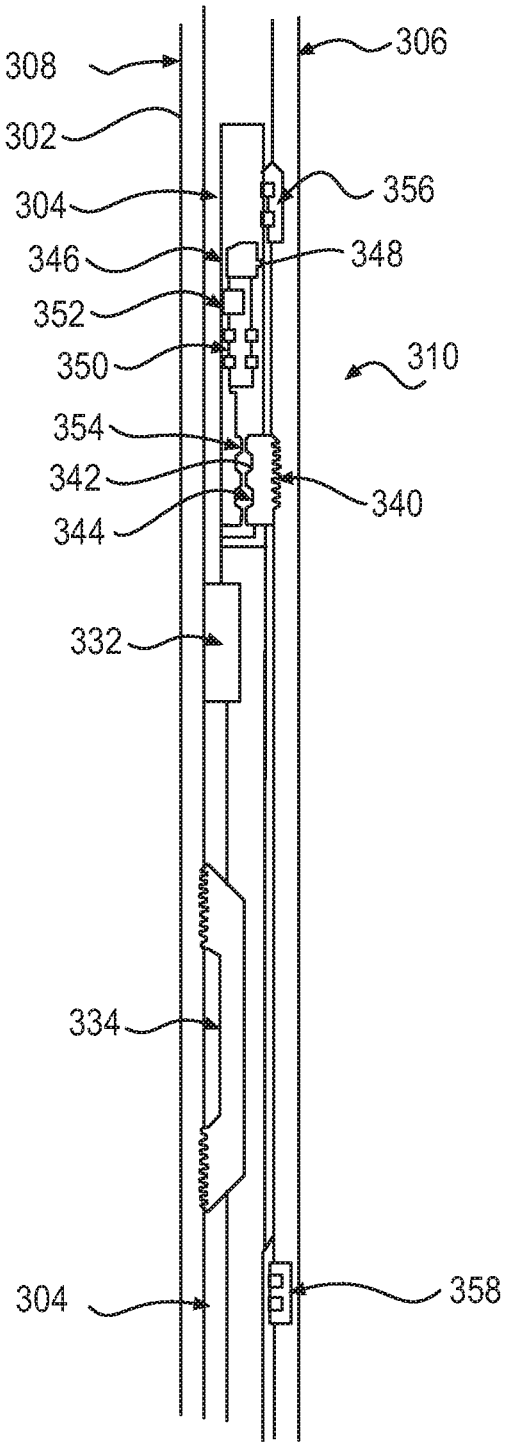
FIG. 7 is a cross-sectional view of a latch to couple a tubular string to a fracturing assembly according to one or more embodiments.

Referring now to FIG. 7, a cross-sectional view of a latch 310 to couple the tubular string 306 to the fracturing assembly 304 in accordance with one or more embodiments of the present disclosure is shown. FIG. 7, in particular, only shows a vertical half of the cross-section of the latch 310, the fracturing assembly 304, and the tubular string 306. The latch 310 is shown as primarily included within the fracturing assembly 304 in this embodiment, but the latch 310 may be included with either or both of the tubular string 306 and the fracturing assembly 304 to couple the two to each other. Further, as the wellbore securing device 312 may include a packer in one or more embodiments to secure the secure the fracturing assembly 304 within the wellbore 302, one or more packer elements 332 and one or more packer slips 334 may be used to secure the fracturing assembly 304 within the wellbore 302, and more particularly within the casing 308 included within the wellbore 302.

As shown, the fracturing assembly 304 may include a fracturing assembly latch profile 342 formed on an interior surface, and the tubular string 306 may include a tubular string latch profile 340 formed on an exterior surface. The latch 310 may then be used to engage the fracturing assembly latch profile 342 with the tubular string latch profile 340 to couple the fracturing assembly 304 to the tubular string 306. In this embodiment, the fracturing assembly latch profile 342 is included on a latch lug 344, with the latch lug 344 included within the fracturing assembly 304. The latch lug may be a number of devices known to those skilled in the art, such as a c-ring, collet, and/or other similar mechanism.

The latch 310 may be actuated hydraulically, pneumatically, electrically, and/or mechanically. Accordingly, in FIG. 7, the latch 310 is shown as hydraulically actuatable to decouple the fracturing assembly 304 from the tubular string 306, such as by decoupling the fracturing assembly 304 from the tubular string 306 when the latch 310 is exposed to a predetermined amount of hydraulic pressure. A piston chamber 346 including a port 348 is formed within the fracturing assembly 304, with a piston 350 movably positioned within the piston chamber 346. The port 348 is exposed to fluid pressure between the fracturing assembly 304 and the tubular string 306, and therefore, depending on the arrangement of seals, fluid pressure applied through the tubular string 306 and/or through the annulus formed about the tubular string 306 may communicate through the port 348 and to the piston 350 to move the piston 350 within the piston chamber 346. A shear pin 352 may be used to secure the piston 350 within the piston chamber 346, in which the piston 350 may then only move within the piston chamber 346 once exposed to a predetermined amount of hydraulic pressure above the rating of the shear pin 352. As the piston 350 moves within the piston chamber 346, the fracturing assembly latch profile 342 on the latch lug 344 moves out of engagement with the tubular string latch profile 340, thereby decoupling the fracturing assembly 304 from the tubular string 306. As shown in FIG. 7, a sleeve 354 is coupled to the piston 350 to move with the piston 350 within the piston chamber 346, in which the sleeve 354 unsupports the latch lug 344 as the piston 350 moves allowing the latch lug to release.

Referring still to FIG. 7, one or more seals may be included between the fracturing assembly 304 and the tubular string 306 to selectively provide fluid communication between the fracturing assembly 304 and the tubular string 306. In this embodiment, a seal 356 is shown as included on the tubular string 306 and positioned above, uphole, or upstream of the latch 310, and a seal 358 is shown as included on the tubular string 306 and positioned below, downhole, or downstream of the latch 310. The seal 356 may be used to prevent fluid from between the inner diameter of the tubing string 306 reaching the annulus formed between the tubular string 306 and the casing 308. This will enable pressure to reach and set the wellbore securing device 312. Once the wellbore securing device 312 is set, additional pressure will actuate the latch 310 as detailed above. The lower seal 358 is there to be positioned within a bore beneath the wellbore securing device 312 once the tubing string 306 is decoupled from the fracturing assembly 304 for cases where the latch 310 in not intended to re-engage.

Figure 8:
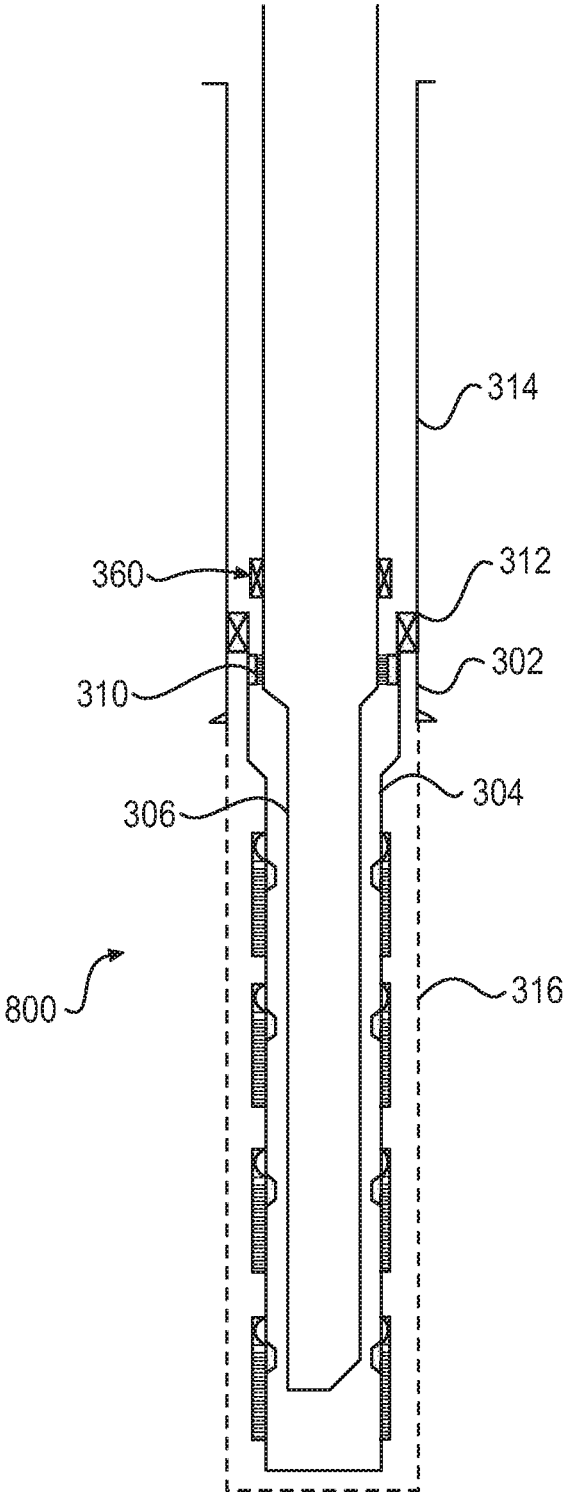
FIG. 8 is a cross-sectional view of a system with a fracturing assembly and a tubular string coupled to each other within a wellbore, according to one or more embodiments.
Figure 9:
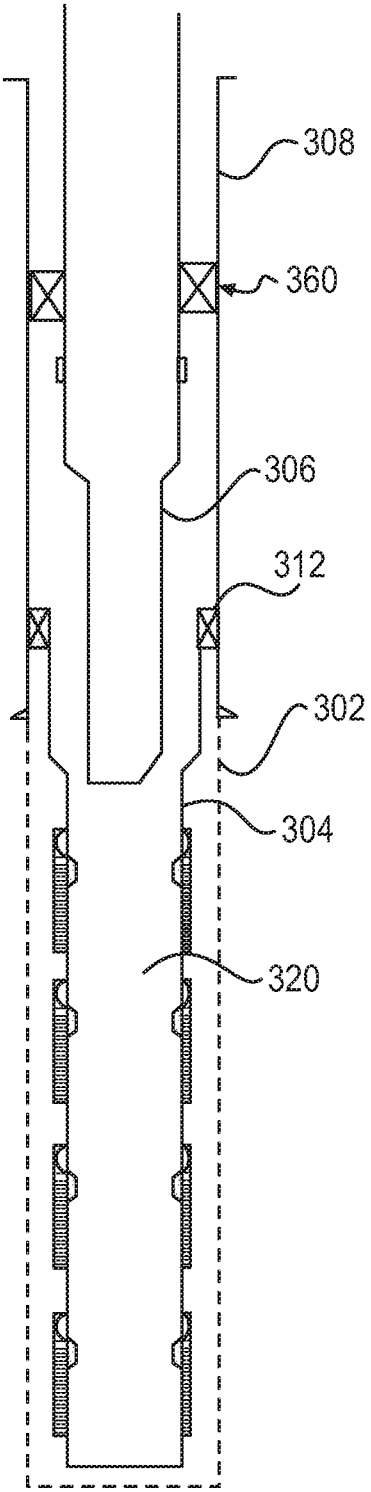
FIG. 9 is a cross-sectional view of a system with a fracturing assembly and a tubular string decoupled from each other within a wellbore, according to one or more embodiments.

Referring now to FIGS. 8 and 9, multiple cross-sectional views of a system 800 for servicing a wellbore 302 in accordance with one or more embodiments of the present disclosure are shown. The system 800 includes a fracturing assembly 304 and a tubular string 306, and may be similar to the system 300 shown in FIGS. 2 and 3. However, in this embodiment, the additional tubing 330 that may be included at the upper end of the fracturing assembly 304, which may be one hundred feet or more, has been removed. FIG. 8 shows a cross-sectional view with the fracturing assembly 304 and the tubular string 306 coupled to each other within the wellbore 302 with the tubular string 306 at least partially positioned within the fracturing assembly 304, and FIG. 9 shows a cross-sectional view with the fracturing assembly 304 and the tubular string 306 decoupled from each other and the tubular string 306 removed from within the fracturing assembly 304.

The system 800 is deployed into the wellbore 302 with the tubular string 306 and the fracturing assembly 304 coupled to each other through the latch 310, and in this embodiment the tubular string 306 is at least partially positioned or inserted within the fracturing assembly 304. The tubular string 306 may be used to deploy and position the fracturing assembly 304 in a desired position and orientation within the wellbore 302, and once in a desired position, the wellbore securing device 312 may be used to secure the fracturing assembly 304 within the wellbore 302. The fracturing assembly 304 is positioned within and extends into the uncased portion 316 of the wellbore 302, with the wellbore securing device 312 set at a lower end of the cased portion 314 of the wellbore 302.

Once in the desired position, the tubular string 306 may decouple from the fracturing assembly 304 through the latch 310, with the tubular string 306 then removed from within the fracturing assembly 304, as shown in FIG. 9. The tubular string 306 may include a wellbore securing device 360 to secure the tubular string 306 within the wellbore 302. The wellbore securing device 360 may also be used to prevent fluid being communicated into an annulus formed between the casing 308 and an exterior of the tubular string 306, such as fluid pumped on the interior of the tubular string 306 from within the fracturing assembly 304 and the casing 308. The wellbore securing device 360 may include a packer or a hanger to set and secure the tubular string 306 within the wellbore 302. As the tubular string 306 may need to be moved within the wellbore 302 multiple times, the wellbore securing device 360 may be resettable. Accordingly, the wellbore securing device 360 may be a hydraulic-set packer, a hydrostatic-set packer, or a mechanical-set packer.

When proppant accumulates within the fracturing assembly 304, the wellbore securing device 360 may be unset for the tubular string 306 to be inserted into the fracturing assembly 304. Once at the desired depth, the reverse circulation process may be used with cleaning fluid to remove the proppant accumulated within the fracturing assembly 304. After the proppant has been removed, the tubular string 306 may be removed from the interior of the fracturing assembly 304, reset or secured using the wellbore securing device 360, and fracturing fluid may resume being pumped through the interior of the tubular string 306 to continue serving the wellbore 302.

The present disclosure includes apparatuses, systems, and methods for positioning and cleaning out a fracturing assembly with a tubular string within a wellbore. As discussed below, the tubular string is used to deploy and position the fracturing assembly in a desired position and orientation within the wellbore. A wellbore securing device, such as a packer or a hanger, is used to secure the fracturing assembly within the wellbore, and a latch is used to removably couple the fracturing assembly to the tubular string to position the fracturing assembly within the wellbore with the tubular string.

The fracturing assembly includes a housing with a flowbore formed therein and a port, and a sliding sleeve configured to move with respect to the housing to selectively allow fluid communication from the flowbore to an exterior of the housing through the port. The sliding sleeve is configured to enable the tubular string to be inserted within a bore of the sliding sleeve when the fracturing assembly and the tubular string are decoupled from each other, such as when cleaning out the fracturing assembly from proppant building up within the fracturing assembly. The sliding sleeve includes a seat engageable with a seat engagement device to move the sliding sleeve between a closed position to prevent fluid communication through the port and an open position to enable fluid communication through the port. In particular, the seat may be selectively movable from an expanded position to enable the seat engagement device to pass through the seat and a retracted position to engage the seat engagement device. An inner diameter of the seat in the expanded position is then larger than an outer diameter of a lower portion of the tubular string to enable the tubular string to pass through the seat of the sliding sleeve for cleaning out the fracturing assembly with the tubular string. Selected example embodiments are discussed below, for purpose of illustration, in the context of an onshore oil and gas system. However, it will be appreciated by those skilled in the art that the disclosed principles are equally well suited for use in other contexts, such as on other types of oil and gas rigs, including offshore oil and gas rigs.

As mentioned above, apparatuses, systems, and methods may be used when positioning and cleaning out a fracturing assembly with a tubular string within a wellbore. In such an embodiment, a tubular string may be used to deploy a fracturing assembly to a desired location within a wellbore, with the fracturing assembly then used to treat the wellbore. In the event of proppant accumulating within the fracturing assembly or a "sand out," the tubular string may then be inserted into the fracturing assembly to reverse circulate the proppant out of the fracturing assembly. As the tubular string is already downhole and used to deploy the fracturing assembly, the tubular string is already in position to clean out the fracturing assembly, as opposed to having to run additional tubing or tools from the surface to the location of the fracturing assembly.

In addition to the embodiments described above, many examples of specific combinations are within the scope of the disclosure, some of which are detailed below:

Example 1

A wellbore apparatus positionable within a wellbore with a tubular string, comprising:

a fracturing assembly comprising:

- a housing comprising a flowbore formed therein and a port;
- a flow control device configured to move with respect to the housing to selectively allow fluid communication from the flowbore to an exterior of the housing through the port; and
- a wellbore securing device configured to secure the fracturing assembly within the wellbore; and a latch configured to removably couple the fracturing assembly to the tubular string.

Example 2

The apparatus of Example 1, wherein the flow control device is adjustable to enable the tubular string to be inserted within a bore of the flow control device.

Example 3

The apparatus of Example 1, wherein the flow control device comprises a sliding sleeve movable between a closed position to prevent fluid communication through the port and an open position to enable fluid communication through the port.

Example 4

The apparatus of Example 3, wherein the sliding sleeve comprises a hydraulically actuated sliding sleeve, a pneumatically actuated sliding sleeve, an electrically actuated sliding sleeve, or a mechanically actuated sliding sleeve to move between the closed position and the open position.

Example 5

The apparatus of Example 4, wherein the sliding sleeve comprises a hydraulically actuated sliding sleeve such that the sliding sleeve comprises a seat engageable with a seat engagement device to move the sliding sleeve between the closed position and the open position.

Example 6

The apparatus of Example 5, wherein:
the seat is selectively movable from an expanded position to enable the seat engagement device to pass through the seat and a retracted position to engage the seat engagement device; and
an inner diameter of the seat in the expanded position is larger than an outer diameter of a lower portion of the tubular string to enable the tubular string to pass through the seat of the sliding sleeve.

Example 7

The apparatus of Example 1, wherein the fracturing assembly comprises the latch with the latch configured to selectively engage a tubular string latch profile formed on an exterior of the tubular string.

Example 8

The apparatus of Example 1, wherein the latch is hydraulically actuatable to removably decouple the fracturing assembly from the tubular string.

Example 9

The apparatus of Example 8, wherein the latch comprises:
a latch lug comprising a fracturing assembly latch profile to selectively engage a tubular string latch profile; and
a piston movably positioned within a piston chamber to move the latch lug.

Example 10

The apparatus of Example 9, wherein the latch further comprises:
a sleeve coupled to the piston to move with the piston and engage the latch lug;
a shear pin to secure the piston within the piston chamber; and
a chamber port to provide fluid communication from the wellbore to the piston chamber through the chamber port to selectively move the piston within the piston chamber.

Example 11

The apparatus of Example 1, further comprising a seal positioned between an interior of the housing and an exterior of the tubular string, wherein the seal is positioned on the tubular string.

Example 12

The apparatus of Example 1, wherein the wellbore securing device comprises a packer or a hanger.

Example 13

The apparatus of Example 12, wherein the packer comprises a hydraulic-set packer, a hydrostatic-set packer, or a mechanical-set packer.

Example 14

The apparatus of Example 1, wherein the tubular string comprises a second wellbore securing device configured to secure the tubular string within the wellbore.

Example 15

The apparatus of Example 14, wherein the fracturing assembly is configured to receive the tubular string therein when the fracturing assembly and the tubular string are decoupled from each other.

Example 16

A method of cleaning out a fracturing assembly within a wellbore, the method comprising:
positioning the fracturing assembly within the wellbore with a tubular string;
securing the fracturing assembly within the wellbore;
pumping a fracturing fluid into the tubular string, through the fracturing assembly, and into the wellbore;
decoupling the tubular string from the fracturing assembly;
inserting the tubular string into a bore of the fracturing assembly; and
pumping a cleaning fluid into an annulus formed between an exterior of the tubular string and an interior of the fracturing assembly.

Example 17

The method of Example 16, further comprising:
removing the tubular string from the bore of the fracturing assembly;
re-pumping the fracturing fluid into the tubular string, through the fracturing assembly, and into the wellbore; and
securing the tubular string within the wellbore with a second wellbore securing device.

Example 18

The method of Example 16, further comprising:
moving a seat of a sliding sleeve from a retracted position to an expanded position such that that an inner diameter of the seat in the expanded position is larger than an outer diameter of a lower portion of the tubular string; and
engaging the seat of the sliding sleeve with a seat engagement device when in the retracted position to move the sliding sleeve from a closed position to prevent fluid communication through a port of the fracturing assembly and an open position to enable fluid communication through the port.

Example 19

The method of Example 16, further comprising:
pumping the cleaning fluid above a predetermined pressure to release a latch and decouple the tubular string from the fracturing assembly.

Example 20

A wellbore apparatus positionable within a wellbore, comprising:
a fracturing assembly, comprising:
- a housing comprising a flowbore formed therein and a port;
- a sliding sleeve comprising a seat selectively movable from an expanded position to enable a seat engagement device to pass through the seat and a retracted position to engage the seat engagement device and move the sliding sleeve with respect to the housing from a closed position to an open position to allow fluid communication from the flowbore to an exterior of the housing through the port;
- a wellbore securing device configured to secure the fracturing assembly within the wellbore; and a tubular string comprising an outer diameter that is smaller than an inner diameter of the seat when in the expanded positioned to enable the tubular string to pass through the seat of the sliding sleeve; and
a latch configured to removably couple the fracturing assembly to the tubular string.

This discussion is directed to various embodiments of the invention. The drawing figures are not necessarily to scale. Certain features of the embodiments may be shown exaggerated in scale or in somewhat schematic form and some details of conventional elements may not be shown in the interest of clarity and conciseness. Although one or more of these embodiments may be preferred, the embodiments disclosed should not be interpreted, or otherwise used, as limiting the scope of the disclosure, including the claims. It is to be fully recognized that the different teachings of the embodiments discussed may be employed separately or in any suitable combination to produce desired results. In addition, one skilled in the art will understand that the description has broad application, and the discussion of any embodiment is meant only to be exemplary of that embodiment, and not intended to intimate that the scope of the disclosure, including the claims, is limited to that embodiment.

Within this document, a reference identifier may be used as a general label, for example "101," for a type of element and alternately used to indicate a specific instance or characterization, for example "101A" and 101B," of that same type of element.

Certain terms are used throughout the description and claims to refer to particular features or components. As one skilled in the art will appreciate, different persons may refer to the same feature or component by different names. This document does not intend to distinguish between components or features that differ in name but not function, unless specifically stated. In the discussion and in the claims, the terms "including" and "comprising" are used in an open-ended fashion, and thus should be interpreted to mean "including, but not limited to . . . ." Also, the term "couple" or "couples" is intended to mean either an indirect or direct connection. In addition, the terms "axial" and "axially" generally mean along or parallel to a central axis (e.g., central axis of a body or a port), while the terms "radial" and "radially" generally mean perpendicular to the central axis. The use of "top," "bottom," "above," "below," and variations of these terms is made for convenience, but does not require any particular orientation of the components.

Reference throughout this specification to "one embodiment," "an embodiment," or similar language means that a particular feature, structure, or characteristic described in connection with the embodiment may be included in at least one embodiment of the present disclosure. Thus, appearances of the phrases "in one embodiment," "in an embodiment," and similar language throughout this specification may, but do not necessarily, all refer to the same embodiment.

Although the present invention has been described with respect to specific details, it is not intended that such details should be regarded as limitations on the scope of the invention, except to the extent that they are included in the accompanying claims.

What is claimed is:

1. A wellbore apparatus positionable within a wellbore with a tubular string, comprising:
- a fracturing assembly comprising:
  - a housing comprising a flowbore formed therein and a port;
  - a flow control device movable with respect to the housing to selectively allow fluid communication from the flowbore to an exterior of the housing through the port; and
  - a wellbore securing device engageable with a wall of the wellbore to secure the fracturing assembly within the wellbore; and
- a latch configured to removably couple the fracturing assembly to the tubular string, wherein the latch is hydraulically actuatable to removably decouple the fracturing assembly from the tubular string and the latch comprises:
  - a latch lug comprising a fracturing assembly latch profile to selectively engage a tubular string latch profile;
  - a piston movably positioned within a piston chamber to move the latch lug;
  - a sleeve coupled to the piston to move with the piston and engage the latch lug;
  - a shear pin to secure the piston within the piston chamber; and
  - a chamber port to provide fluid communication from the wellbore to the piston chamber through the chamber port to selectively move the piston within the piston chamber.

2. The apparatus of claim 1, wherein the flow control device is adjustable to enable the tubular string to be inserted within a bore of the flow control device.

3. The apparatus of claim 1, wherein the flow control device comprises a sliding sleeve movable between a closed position to prevent fluid communication through the port and an open position to enable fluid communication through the port.

4. The apparatus of claim 3, wherein the sliding sleeve comprises a hydraulically actuated sliding sleeve, a pneumatically actuated sliding sleeve, an electrically actuated sliding sleeve, or a mechanically actuated sliding sleeve to move between the closed position and the open position.

5. The apparatus of claim 4, wherein the sliding sleeve comprises a hydraulically actuated sliding sleeve such that the sliding sleeve comprises a seat moveable to move the sliding sleeve between the closed position and the open position.

6. The apparatus of claim 5, wherein:

the seat is selectively movable from an expanded position to enable a seat engagement device to pass through the seat and a retracted position so as to be engageable by the seat engagement device; and an inner diameter of the seat in the expanded position is larger than an outer diameter of a lower portion of the tubular string to enable the tubular string to pass through the seat of the sliding sleeve.

7. The apparatus of claim 1, wherein the fracturing assembly comprises the latch with the latch configured to selectively engage the tubular string latch profile formed on an exterior of the tubular string.

8. The apparatus of claim 1, further comprising a seal positioned between an interior of the housing and an exterior of the tubular string, wherein the seal is positioned on the tubular string.

9. The apparatus of claim 1, wherein the wellbore securing device comprises a packer or a hanger.

10. The apparatus of claim 9, wherein the packer comprises a hydraulic-set packer, a hydrostatic-set packer, or a mechanical-set packer.

11. The apparatus of claim 1, wherein the tubular string comprises a second wellbore securing device engageable with the wall of the wellbore to secure the tubular string within the wellbore.

12. The apparatus of claim 11, wherein the fracturing assembly is configured to receive the tubular string therein when the fracturing assembly and the tubular string are decoupled from each other.

13. A method of cleaning out a fracturing assembly within a wellbore drilled from the Earth's surface, the method comprising:

positioning the fracturing assembly within the wellbore with a tubular string coupled to the fracturing assembly;

securing the fracturing assembly within the wellbore;

pumping a fracturing fluid into the tubular string, through the fracturing assembly, and into the wellbore;

decoupling the tubular string from the fracturing assembly;

inserting the tubular string into a bore of the fracturing assembly; and pumping a cleaning fluid from the surface into an annulus formed between an exterior of the tubular string and an interior of the fracturing assembly.

14. The method of claim 13, further comprising:

removing the tubular string from the bore of the fracturing assembly;

re-pumping the fracturing fluid into the tubular string, through the fracturing assembly, and into the wellbore; and securing the tubular string within the wellbore.

15. The method of claim 13, further comprising:

moving a seat of a sliding sleeve from a retracted position to an expanded position such that that an inner diameter of the seat in the expanded position is larger than an outer diameter of a lower portion of the tubular string; and engaging the seat of the sliding sleeve with a seat engagement device when in the retracted position to move the sliding sleeve from a closed position to prevent fluid communication through a port of the fracturing assembly and an open position to enable fluid communication through the port.

16. The method of claim 13, further comprising pumping the cleaning fluid above a predetermined pressure to release a latch and decouple the tubular string from the fracturing assembly.

* * * * *